United States Patent [19]

Johnsen

[11] 3,971,509

[45] July 27, 1976

[54] CENTRIFUGE COMPRISING AN OUTER DRUM AND AN INNER ROTOR PROVIDED WITH A CONVEYOR SCREW

[75] Inventor: Frank Birger Johnsen, Virum, Denmark

[73] Assignee: Titan Separator A/S, Soborg, Denmark

[22] Filed: Sept. 24, 1974

[21] Appl. No.: 508,942

[30] Foreign Application Priority Data

Oct. 1, 1973 Germany ..... 2349298

[52] U.S. Cl. ..... 233/7; 233/14 R; 233/1 D

[51] Int. Cl.[2] ..... B04B 1/20; B04B 15/12

[58] Field of Search ..... 233/1 D, 7, 14 R, 14 A, 233/27

[56] References Cited

UNITED STATES PATENTS

| | | | |
|---|---|---|---|
| 1,699,471 | 1/1929 | Laughlin | 233/7 |
| 1,710,315 | 4/1929 | Laughlin | 233/7 |
| 2,685,369 | 8/1954 | Crossley | 233/7 X |
| 3,228,594 | 1/1966 | Amero | 233/14 R |
| 3,854,658 | 12/1974 | Probstmeyer | 233/14 R |

FOREIGN PATENTS OR APPLICATIONS

| | | | |
|---|---|---|---|
| 1,295,494 | 5/1969 | Germany | 233/7 |

*Primary Examiner*—George H. Krizmanich
*Attorney, Agent, or Firm*—Beveridge, DeGrandi, Kline & Lunsford

[57] ABSTRACT

A centrifuge comprising an elongated rotary drum and a rotor journalled coaxially within the drum for rotation at a slightly different speed. Means are provided for supplying a raw material containing a solid and a liquid phase to the separating space defined by the drum and the rotor. The rotor carries at least two continuous screw helices for transporting solid matter axially towards one end of the separating space. An aperture is provided in each helix whereby the axial movement of at least some of the transported solid matter is temporarily stopped when that matter passes through the aperture. A washing liquid is supplied through openings in the rotor shortly upstream of each aperture for acting upon the solid matter during the period in which its axial movement is interrupted. The apertures in the helices are off-set relative to one another along the circumference of the rotor.

5 Claims, 2 Drawing Figures

CENTRIFUGE COMPRISING AN OUTER DRUM AND AN INNER ROTOR PROVIDED WITH A CONVEYOR SCREW

BACKGROUND OF THE INVENTION

The present invention relates to a centrifuge comprising an outer drum, means journalling said drum for rotation about an axis, a hollow rotor mounted coaxially within said drum and defining therewith a separating space, means for supplying a raw material including a liquid phase and a solid phase to said separating space, outlet means for discharging said liquid and solid phases separately from said separating space, a conveyor screw secured externally to said rotor for axially conveying said solid phase towards the associated outlet means, said conveyor screw having at least two continuous helices, at least one interruption in said conveyor screw intermediate the ends thereof, and means for supplying a washing liquid into the separating space through an opening located adjacent said interruption.

German patent specification No. 1,295,494 discloses a centrifuge of this kind, in which the portions of the screw helix adjoining the interruption therein are axially off-set or staggered relative to one another, so that the leading edge (as determined by the rotation of the screw conveyor relative to the drum) of the interruption is located downstream or forwardly (as viewed in the flow direction of the solid phase) of the trailing edge of the interruption. In other words, the interruption is formed substantially as a slit located in a plane including the axis of the drum and the rotor. In this known centrifuge, the solid matter transported by the conveyor screw is subjected to a certain mechanical working in the region of the interruption, resulting in some loosening of the solids which promotes the washing effect of the liquid supplied through the opening in the rotor wall. Due to the interruption in the screw helix, at least the layer of the solids adjacent the active face of the screw loses the contact with the screw face, so that the inner cohesion of the solids is partially broken, and a certain agitation is effected. The loosened and rearranged solid material is subsequently intercepted by the trailing or rearward edge of the slit, and the temporarily interrupted movement of the material towards the outlet is reassumed.

SUMMARY OF THE INVENTION

According to the present invention there is provided a centrifuge comprising an outer drum, means journalling said drum for rotation about an axis, a hollow rotor mounted coaxially within said drum and defining therewith a separating space, means for supplying a raw material including a liquid phase and a solid phase to said separating space, outlet means for discharging said liquid and solid phases separately from said separating space, means for rotating said drum and said rotor at different rotational speeds, a conveyor screw secured externally to said rotor for axially conveying said solid phase towards the associated outlet means, said conveyor screw having at least two continuous helices, at least one aperture in one of said screw helices which aperture is defined by portions of said helix located in a common helicoid surface, an opening in said rotor adjacent said aperture and means for supplying a washing liquid through said opening into said separating space.

In a centrifuge according to the invention, the efficiency of the mechanical working, to which the solid material is subjected due to the temporary interruption of its axial movement, may be substantially increased. This is due to the combined effect of two distinct features of the invention. Firstly, the aperture interrupting the continuous screw helix is located in the helicoid surface proper rather than between two axially off-set helicoid surface portions as in the known centrifuge discussed above, and consequently its dimension in the circumferential direction can be considerably larger than in the known centrifuge. This results in an improved rearrangement and redistribution of the solid matter passing through the aperture. Secondly, whereas in the known centrifuge the axial movement of the solid matter is reassumed as soon as the solids are caught by the face portion of the conveyor screw immediately adjacent the trailing edge of the slit therein, the solids now remain stationary and are subjected to the agitating and rinsing effect of the washing liquid until they contact the subsequent helix of the multistart screw. Consequently, the duration of the period in which the movement of the solid matter towards the outlet is interrupted and during which it can be rearranged, is increased several times. This increases the efficiency of the washing operation considerably, also because a larger amount of washing liquid can be supplied in the relatively long interval between the screw helix in which the aperture is provided, and the subsequent helix. The extended period during which the solid matter stays between said helices also ensures a more effective separation of the washing liquid and the solids in response to the centrifugal forces. Furthermore, there is a greater freedom in respect of the arrangement of the opening through which the washing liquid is supplied to the separating space, and the liquid may be supplied at a higher pressure, if desired.

In a preferred embodiment the aperture is open towards the circumference of the screw helix and its radially innermost part is spaced from the wall of the rotor. Since each screw helix may thus consist of a single, continuous strip of sheet material, the manufacture and the assembly of the helices is simplified.

The inlet opening for the washing liquid may be located upstream of the aperture in the screw helix — as viewed in the axial flow direction of the solid phase transported by the screw — which promotes the aforementioned increase in the efficiency of the washing process.

When the screw is provided with an aperture in each of its helices, the interior of the rotor may be divided into at least two axially spaced chambers and there may be provided a separate supply duct and a separate discharge opening for washing liquid in connection with each chamber. This permits a successive treatment of the solid material with different liquids to be effected in the separating space, if desired, and it is possible to effect an individual control of the static pressure which acts upon the washing liquid in each of the chambers and determines the outflow velocity of the liquid from the chamber.

BRIEF DESCRIPTION OF THE DRAWING

The invention will now be explained in greater detail with reference to the accompanying drawing, in which.

DETAILED DESCRIPTION

Figure 1:
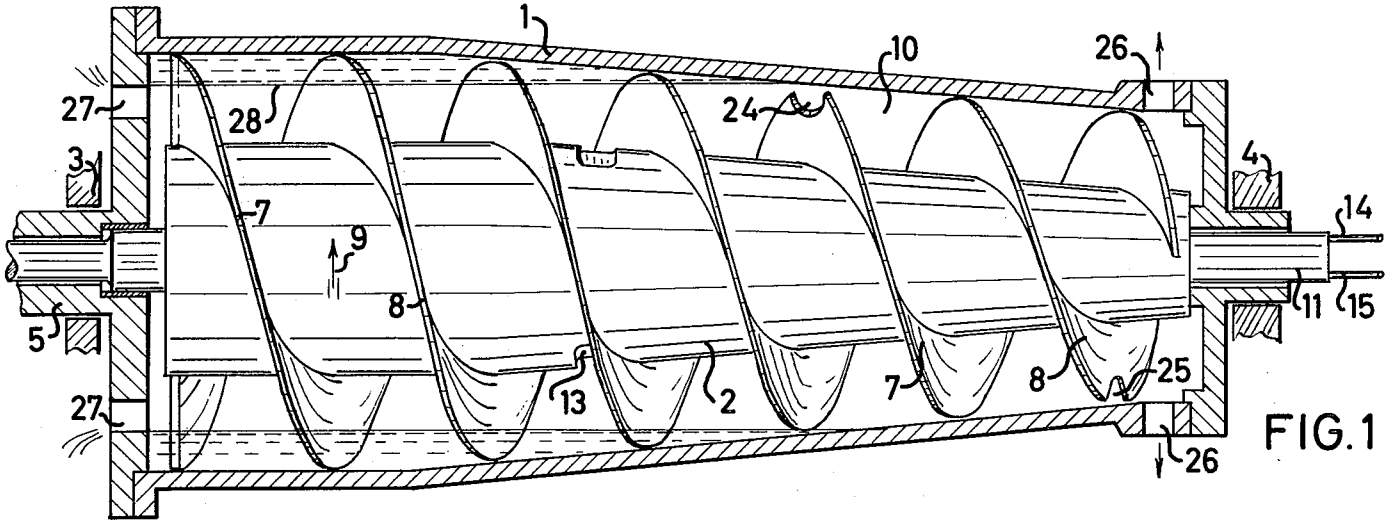
FIG. 1 shows a diagrammatic side elevation of the internal rotor of a centrifuge embodying the invention and an axial section through the external drum.
Figure 2:
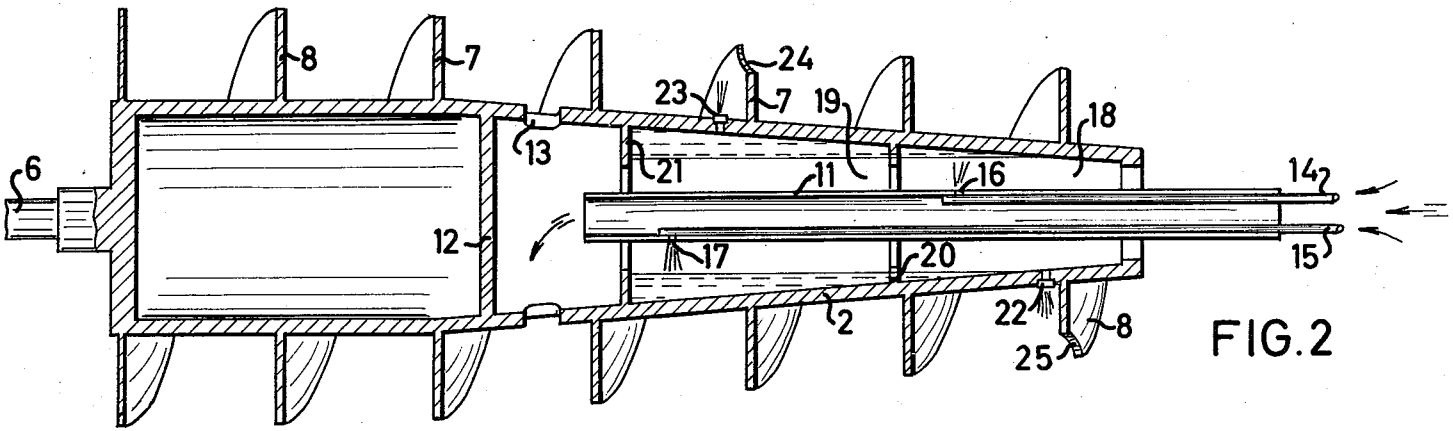
FIG. 2 shows an axial section through the internal rotor only.

The centrifuge illustrated in the drawing comprises an external drum 1 and an internal rotor 2 arranged coaxially therewith, both of which are conical over a substantially proportion of their length. At its ends, drum 2 is journalled in schematically indicated bearings 3 and 4, while the internal rotor is journalled, at its ends, in the external drum. By means of stub shafts 5 and 6, respectively, at their left-hand ends, the drum and the rotor are coupled to a drive mechanism (not shown) which is able to drive the drum and the rotor with slightly different angular velocities.

A twin-winding screw is secured to the internal rotor, and the windings or helices of the screw are designated by 7 and 8. Due to the difference in the rates of revolutions of the drum and the rotor, which difference corresponds to a relative rotation of the internal rotor 2 in the direction indicated by arrow 9, the screw 7, 8 exerts a conveying effect directed towards the right-hand side of the drawing on the solid material which is deposited on the wall of drum 1 due to the centrifuging process occurring in the separating space 10 between the drum and the rotor.

The raw material to be centrifuged is fed through a stationary pipe 11 which extends into the internal rotor 2 and which terminates some distance in front of a transversally extending partition 12 in the drum. The material reaches separating space 10 via apertures 13 in the rotor wall.

Two smaller supply pipes 14 and 15 for washing liquid are secured to the inside of pipe 11 and these pipes communicate with two distributor chambers 18 and 19 in rotor 2 via openings 16 and 17 in the wall of pipe 11. The chambers are separated from each other and from that space of the drum interior to which the raw material is supplied, by means of annular radial partitions 20 and 21.

In the embodiment illustrated, the wall of rotor 2 has a discharge opening from each of chambers 18 and 19 and suitable discharge nozzles 22 and 23 are secured in these openings. Each of said nozzles is located relatively closely behind a screw helix 7 or 8, respectively, and each helix is provided with an arcuate aperture 24 and 25, respectively, which extends from the edge of the respective screw helix towards the wall of rotor 2 in the same axial plane in which the associated nozzle is located.

When a raw material which contains a solid phase and a liquid phase is fed through pipe 11 and reaches separating space 10 via the apertures 13, a separation of the solids from the liquid is effected due to the rotation of the drum and the rotor. The solids are transported by means of screw 7, 8 towards the right in FIG. 1 and discharged through apertures 26 at the right-hand end of drum 1. The liquid leaves the drum through overflow apertures 27 at the left-hand end of the drum and the location of these apertures determines the level 28 of the liquid present in drum 1.

During the transport of the solids towards the right-hand end, at least a part of the conveyed solid material, at a certain moment, "slides back" through each of the two apertures 24 and 25, whereby the axially advancing movement of the material is temporarily discontinued until the active or leading face of the following helix of the conveying screw intercepts the said part of the solid matter so that the advancing movement continues. During this period, the solid material is exposed to the action of the washing liquid supplied through the associated discharge nozzle 22 or 23 which liquid is mixed with that volume of the original liquid which still adheres to the solid material and thus gives rise to a diluting or washing effect. Moreover, when the solid material passes through the aperture in the screw helix, a certain loosening and rearrangement of the material takes place, whereby the efficiency of the washing liquid is improved.

The invention is by no means restricted to the embodiment illustrated in the drawing. By way of example, the transporting screw may comprise more than two windings and each winding may be provided with several apertures. The apertures do not have to extend from the edge of the screw helices in that they could, by way of example, be formed with an outer edge spaced from the edge of the screw helices, thus leaving an uninterrupted edge zone adjacent the wall of the outer drum. It is only essential that the apertures have a relatively large extension along the circumference of the helices so that they permit a relatively unimpeded passage of a large portion of the solid material and that the interrupted transport of the solids passing through the apertures is resumed by the active face of the following screw helix.

I claim:

1. In a centrifuge for separating a solid phase from a liquid phase, said centrifuge including a drum, means journalling said drum for rotation about an axis, a hollow rotor mounted coaxially within said drum and defining therewith a separating space, a conveyor screw secured externally to said rotor and comprising at least two continuous helices defining between them helical ducts, means for supplying a raw material including said liquid and solid phases to each of said helical ducts, outlet means at opposite ends of said separating space for discharging said liquid and solid phases separately therefrom, the improvement comprising at least one aperture in each of said screw helices intermediate the ends thereof, said apertures extending inwardly from the outer periphery of the respective said screw helices and being located in a common helicoid surface, an opening in said rotor adjacent each of said apertures, and means for supplying a washing liquid through each opening into said separating space.

2. A centrifuge as claimed in claim 1, wherein the radially innermost part of said aperture is spaced from said rotor.

3. A centrifuge as claimed in claim 1, wherein said washing liquid inlet opening is located upstream of said aperture, as viewed in the flow direction of said solid phase towards the associated outlet means.

4. A centrifuge as claimed in claim 1 wherein said apertures are off-set relative to one another along the circumference of the conveyor screw.

5. A centrifuge as claimed in claim 4 including means defining at least two axially spaced chambers within said rotor, a supply duct associated with each chamber for supplying washing liquid thereto and an opening in the rotor connecting each chamber with said separating space.

* * * * *